US009085164B2

(12) United States Patent
Domae et al.

(10) Patent No.: US 9,085,164 B2
(45) Date of Patent: Jul. 21, 2015

(54) LIQUID JET HEAD AND LIQUID JET APPARATUS

(71) Applicant: SII Printek Inc., Chiba (JP)

(72) Inventors: Yoshinori Domae, Chiba (JP); Osamu Koseki, Chiba (JP); Yuki Yamamura, Chiba (JP); Yuzuru Kubota, Chiba (JP); Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 13/713,055

(22) Filed: Dec. 13, 2012

(65) Prior Publication Data

US 2013/0169717 A1 Jul. 4, 2013

(30) Foreign Application Priority Data

Dec. 16, 2011 (JP) ..... 2011-276297
Sep. 28, 2012 (JP) ..... 2012-217983

(51) Int. Cl.
*B41J 2/175* (2006.01)
*B41J 2/14* (2006.01)

(52) U.S. Cl.
CPC ..... *B41J 2/175* (2013.01); *B41J 2/14209* (2013.01); *B41J 2002/14419* (2013.01); *B41J 2202/11* (2013.01); *B41J 2202/12* (2013.01)

(58) Field of Classification Search
USPC ..... 347/57–72
See application file for complete search history.

(56) References Cited

U.S. PATENT DOCUMENTS 8,480,214 B2 * 7/2013 Tsubaki ..... 347/85
2009/0284563 A1 * 11/2009 Bansyo ..... 347/19
2010/0207972 A1 * 8/2010 Kawai ..... 347/6
2010/0238238 A1 * 9/2010 Yamamoto ..... 347/85
2012/0062659 A1 3/2012 Tsubaki ..... 347/85
2013/0083143 A1 * 4/2013 Sakata et al. ..... 347/89

FOREIGN PATENT DOCUMENTS

JP 4263742 6/2007
JP 2011093200 5/2011
WO 2005007415 1/2005
WO WO 2005007415 A2 * 1/2005 ..... B41J 2/175

OTHER PUBLICATIONS

British IPO Search Report mailed Apr. 12, 2013 issued in GB Appln. No. GB1222542.1.

* cited by examiner

*Primary Examiner* — Matthew Luu
*Assistant Examiner* — Lily Kemathe
(74) *Attorney, Agent, or Firm* — Adams & Wilks

(57) ABSTRACT

A liquid jet head includes a flow path member having a supply port through which liquid is supplied and a discharge port through which the liquid is discharged, and a cover plate having a liquid supply chamber that communicates with the supply port and a liquid discharge chamber that communicates with the discharge port. An actuator substrate has a plurality of parallel channels that extend between the liquid supply chamber and the liquid discharge chamber and the channels communicate with respective nozzles formed in a nozzle plate. The flow path member, cover plate, actuator substrate and nozzle plate constitute a laminated structure. A communication path is provided in one or both of the cover plate and flow path member for bypassing the liquid from the liquid supply chamber to the liquid discharge chamber so that air bubbles trapped in the liquid can be effectively discharged to the outside.

20 Claims, 8 Drawing Sheets

W2
W1
D
1
2
3
4
5
6a
6b
7
8
9
10
11
12
13
14
17
R
C
E

LIQUID JET HEAD AND LIQUID JET APPARATUS

BACKGROUND OF THE INVENTION

1. Field of the Invention

The present invention relates to a liquid jet head and a liquid jet apparatus for ejecting liquid from a nozzle to record graphics and characters on a recording medium, or to form a functional thin film thereon.

2. Description of the Related Art

In recent years, there has been used an ink-let type liquid jet head for ejecting ink droplets on recording paper or the like to record characters or graphics thereon, or for ejecting a liquid material on a surface of an element substrate to form a functional thin film thereon. In such a liquid jet head, ink or a liquid material, is supplied from a liquid tank via a supply tube to the liquid jet head, and ink or a liquid material filled into a channel is ejected from a nozzle which communicates with the channel. When ink is ejected, the liquid jet head or a recording medium on which a pattern of jetted liquid is to be recorded is moved to record characters or graphics, or to form a functional thin film in a predetermined shape.

Japanese Patent Application Laid-open No. 2011-93200 describes a liquid jet head 100 of this type. FIG. 7 is a perspective view of the liquid jet head illustrated in FIG. 5(*b*) of Japanese Patent Application Laid-open No. 2011-93200. The liquid jet head 100 has a laminated structure of a nozzle plate 101, a piezoelectric plate 102, a cover plate 103, and a flow path member 104. The piezoelectric plate 102 includes a channel row in which a plurality of channels are arrayed. The cover plate 103 closes opening portions of the plurality of channels, and includes a liquid supply chamber 106 for supplying liquid to the respective channels, and a liquid discharge chamber 107 for discharging the liquid from the respective channels. The flow path member 104 includes a supply joint 105*a* through which liquid from an external liquid tank (not shown) flows in, and a discharge joint 105*b* through which the liquid returns to the liquid tank. The nozzle plate 101 includes nozzles 112 communicated with respective ejection channels 110*a* (see FIGS. 8A to 8C).

The liquid supplied from the liquid tank (not shown) flows into the liquid supply chamber 106 via the supply joint 105*a*, and is filled into the channel row formed of the plurality of channels. Then, the liquid flows out from the channel row toward the liquid discharge chamber 107, and returns to the liquid tank via the discharge joint 105*b*. Therefore, the liquid constantly circulates during driving. An air bubble and dust mixed into the liquid circulate and return to the liquid tank together with the liquid. Therefore, occurrence of nozzle clogging is reduced. As a result, liquid replacement and maintenance such as cleaning of the liquid jet head 100 are facilitated, the amount of liquid to be consumed during cleaning is reduced, and the consumption amount of the recording medium is reduced as well. Therefore, there is such an advantage that increase of running cost can be suppressed. Japanese Patent No. 4263742 also describes a liquid circulating type ink jet head.

FIG. 8A is a schematic plan view of the cover plate 103 of the liquid jet head 100, from which the flow path member 104 is removed. FIG. 8B is a schematic sectional view of the liquid jet head 100 taken along the line A-A of FIG. 8A. FIG. 8C is a schematic sectional view of the liquid jet head 100 taken along the line B-B of FIG. 8A.

As illustrated in a partial enlarged view of FIG. 8C, the piezoelectric plate 102 includes the ejection channels 110*a* and dummy channels 110*b* which are alternately arrayed. The cover plate 103 includes a plurality of slits 109 formed in the liquid supply chamber 106 and the liquid discharge chamber 107 on the piezoelectric plate 102 side. The ejection channel 110*a* are communicated with the liquid supply chamber 106 via the slits 109, and the dummy channels 110*b* are closed by the cover plate 103.

The supply joint 105*a* of the flow path member 104 is positioned at substantially the longitudinal center of the liquid supply chamber 106, and the discharge joint 105*b* or the flow path member 104 is positioned at substantially the longitudinal center of the liquid discharge chamber 107. The liquid flows in via the supply joint 105*a* to fill the liquid supply chamber 106 up to both end portions thereof. Then, the liquid flows through the respective ejection channels 110*a* to be discharged to the liquid discharge chamber 107, and then returns to the liquid tank (not shown) via the discharge joint 105*b*.

However, in the liquid jet head 100 of this type, as illustrated in FIG. 8C, an air bubble 111 mixed into the liquid may adhere to end portions of the slits 109 to remain inside the liquid supply chamber 106. When the air bubble 111 adheres to the opening portions of the slits 109, the liquid cannot be supplied to the ejection channels 110*a*, and liquid droplets cannot be ejected at a constant condition. Even when the liquid is pumped from the supply joint 105*a* side in order to remove the air bubble 111, because the flow path resistance of the ejection channel 110*a* is large, the air bubble 111 may not be discharged toward the liquid discharge chamber 107 via the ejection channels 110*a*. It is desired to obtain a liquid jet head 100 capable of, even when the air bubble 111 is mixed into the liquid, removing the air bubble 111 to the outside.

SUMMARY OF THE INVENTION

The present invention has been made in view of the above-mentioned problem, and has an object to provide a liquid jet head capable of rapidly discharging an air bubble mixed into liquid to the outside.

According to an exemplary embodiment of the present invention, there is provided a liquid jet head, including: a supply port through which liquid is supplied; a discharge port through which the liquid is discharged; a liquid supply chamber communicated with the supply port; a liquid discharge chamber communicated with the discharge port; a channel row formed of a plurality of channels provided in parallel to each other between the liquid supply chamber and the liquid discharge chamber, the plurality of channels each being communicated with the liquid supply chamber and the liquid discharge chamber; a plurality of nozzles communicated with the plurality of channels, respectively; and a communication path for bypassing the liquid from the liquid supply chamber to the liquid discharge chamber.

Further, the communication path is provided in a vicinity of a channel farthest from a position of the supply port.

Further, the supply port is positioned at substantially a longitudinal center of one of the liquid supply chamber and the liquid discharge chamber. The communication path is provided in a vicinity of each of both ends of the channel row in a row direction.

Further, the supply port is positioned at one longitudinal end portion of the liquid supply chamber. The communication path is provided in a vicinity of an end portion of the channel row, which corresponds to another longitudinal end portion.

Further, the supply port is positioned at one longitudinal end portion of the liquid supply chamber. The discharge port is positioned at another longitudinal end portion of the liquid discharge chamber. The communication path is provided in a vicinity of each of both ends of the channel row in a row direction.

Further, the supply port is positioned at one longitudinal end portion of the liquid supply chamber. The discharge port is positioned at another longitudinal end portion of the liquid discharge chamber. The communication path is provided in a vicinity of an end portion of the channel row, which corresponds to the another longitudinal end portion.

Further, the communication path has a flow path resistance of liquid, which is smaller than a flow path resistance of liquid of the plurality of channels.

Further, the liquid jet head further includes; an actuator substrate having the channel row formed therein; a cover plate including the liquid supply chamber and the liquid discharge chamber, the cover plate being bonded to the actuator substrate; a flow path member including the supply port and the discharge port, the flow path member being bonded to the cover plate; and a nozzle plate including the plurality of nozzles, the nozzle plate being bonded to the actuator substrate.

Further, the channel row includes a dummy channel and an ejection channel which are alternately arrayed. The cover plate includes a slit between the channel row and each of the liquid supply chamber and the liquid discharge chamber. The liquid supply chamber and the liquid discharge chamber are communicated with the election channel via the slit, and each of the plurality of nozzles is communicated with the ejection channel.

Further, the communication path is provided in the cover plate.

Further, the communication path is provided in the actuator substrate.

According to an exemplary embodiment of the present invention, there is provided a liquid jet apparatus, including: the above-mentioned liquid jet head; a moving mechanism for reciprocating the liquid jet head; a liquid supply tube for supplying liquid to the liquid jet head; and a liquid tank for supplying the liquid to the liquid supply tube.

According to the present invention, the liquid jet head includes: the supply port through which liquid is supplied; the discharge port through which the liquid is discharged; the liquid supply chamber communicated with the supply port; the liquid discharge chamber communicated with the discharge port; the channel row formed of the plurality of channels provided in parallel to each other between the liquid supply chamber and the liquid discharge chamber, the plurality of channels each being communicated with the liquid supply chamber and the liquid discharge chamber; the plurality of nozzles communicated with the plurality of channels, respectively; and the communication path for bypassing the liquid from the liquid supply chamber to the liquid discharge chamber. With this, the air bubble mixed into the liquid may be carried toward an end portion of the liquid supply chamber to pass through the communication path, and be removed from the liquid discharge chamber to the outside. In this manner, deterioration of an ejection characteristic, which is caused by adhesion of the air bubble to the channels and channel opening portions, is prevented.

DETAILED DESCRIPTION OF THE PREFERRED EMBODIMENTS (Basic Configurations)

Figure 1A:
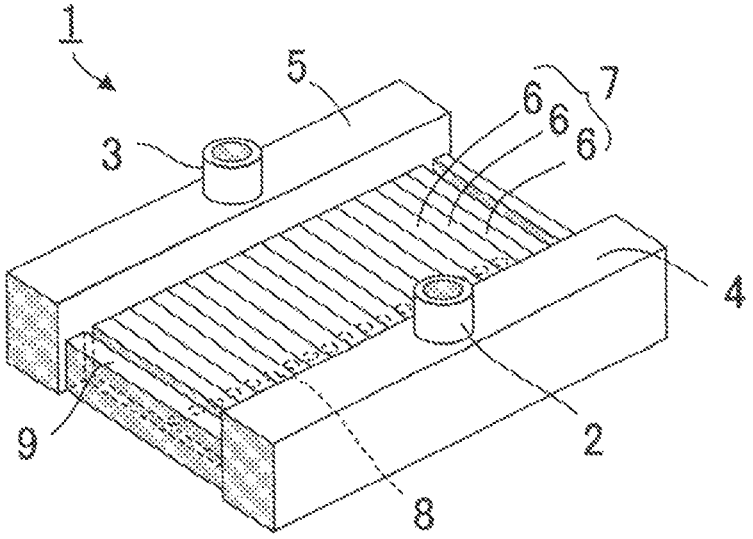
FIGS. 1A to 1C are conceptual diagrams illustrating basic configurations of a liquid jet head of the present invention.
Figure 1B:
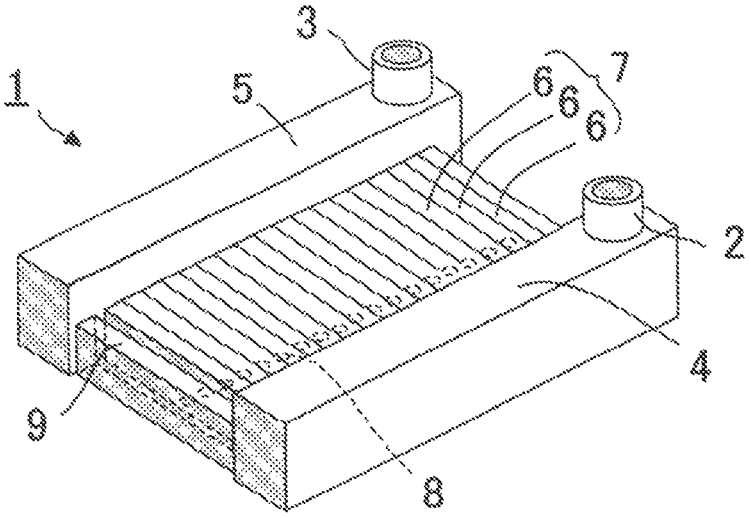
Figure 1C:
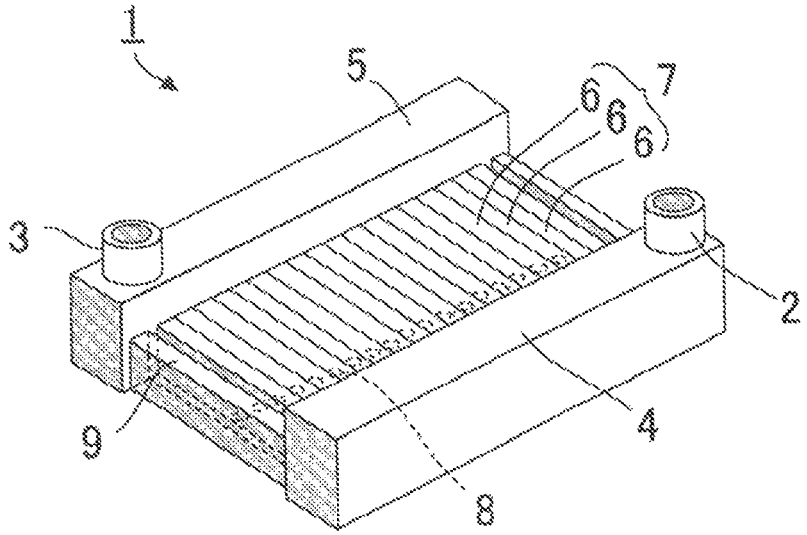

FIGS. 1A, 1B, and 1C are conceptual diagrams illustrating basic configurations of a liquid jet head 1 of the present invention. The liquid jet head 1 of the present invention includes a supply port 2 through which liquid is supplied, a discharge port 3 through which the liquid is discharged, a liquid supply chamber 4 communicated with the supply port 2, a liquid discharge chamber 5 communicated with the discharge port 3, a channel row 7 formed of a plurality of channels 6 provided in parallel to each other between the liquid supply chamber 4 and the liquid discharge chamber 7, the plurality of channels 6 each having one end portion communicated with the liquid supply chamber 4 and the other end portion communicated with the liquid discharge chamber 5, and a plurality of nozzles 8 communicated with the plurality of channels 6, respectively. The liquid jet head 1 further includes a communication path 9 for bypassing the liquid from the liquid supply chamber 4 to the liquid discharge chamber 5.

In the liquid jet head 1 illustrated in FIG. 1A, the supply port 2 is positioned at substantially the longitudinal center of the liquid supply chamber 4. Therefore, the communication path 9 is provided in the vicinity of each of both ends of the channel row 7 in the row direction. Further, in the liquid jet head 1 illustrated in FIG. 1B, the supply port 2 is positioned at one longitudinal end portion of the liquid supply chamber 4. Therefore, the communication path 9 is provided in the vicinity of an end portion of the channel row 7, which corresponds to the other longitudinal end portion of the liquid supply chamber 4. Further, in the liquid jet head 1 illustrated in FIG. 1C, the supply port 2 is positioned at one longitudinal end portion of the liquid supply chamber 4. In addition, the discharge port 3 is positioned at the other longitudinal end portion of the liquid discharge chamber 5. The communication path 9 is provided in the vicinity of each of both ends of the channel row 7 in the row direction.

When liquid flows from a liquid tank (not shown) into the supply port 2, the liquid is filled into the liquid supply chamber 4, and the liquid flows into the respective channels 6 of the channel row 7 communicated with the liquid supply chamber 4. Part of the liquid flowing into the respective channels 6 is ejected from the nozzles 8, and the other part thereof flows out to the liquid discharge chamber 5 to return to the liquid tank via the discharge port 3.

Further, because the communication path 9 is provided, a liquid flow is generated also in a region of the liquid supply chamber 4 separated from the supply port 2. As a result, a liquid flow is generated in a direction crossing opening portions of the channels 6 separated from the supply port 2, the opening portions being opened to the liquid supply chamber 4. With this flow, an air bubble is less liable to adhere to the opening portions of the channels 6. In this manner, even when an air bubble is mixed into liquid, the air bubble is carried toward an end portion of the liquid supply chamber 4 by the liquid flow in the direction crossing the opening portions to pass through the communication path 9, and then removed from the liquid discharge chamber 5 to the outside. Further, even when the air bubble adheres so the opening portions of the channels 6, the adhering air bubble can be easily removed via the liquid discharge chamber 5 and the discharge port 3 by pumping liquid from the supply port 2 to carry the air bubble toward the communication path 9. As a result, maintenance is facilitated.

Note that, it is preferred that the communication path 9 be provided in the vicinity of the channel 6 farthest from the position of the supply port 2. In the liquid jet head 1 illustrated in FIG. 1A, the supply port 2 is positioned at substantially the longitudinal center of the liquid supply chamber 4, and the channel 6 farthest from the position of the supply port 2 is the channel 6 at each of both the ends of the channel row 7. Thus, the communication path 9 is provided in the vicinity of the channel 6 at each of both the ends. In the liquid jet head 1 illustrated in FIG. 1B, the supply port 2 is positioned at the one longitudinal end portion of the liquid supply chamber 4, and the channel 6 farthest from the position of the supply port 2 is the channel 6 at the other longitudinal end portion of the channel row 7, which is on the side opposite to the above-mentioned one longitudinal end portion. As a result, the communication path 9 is provided in the vicinity of this channel 6. When the communication path 9 is provided as described above, a liquid flow is generated for all of the channels 6 in a direction crossing the opening portions opened to the liquid supply chamber 4. With this flow, the air bubble is is less liable to adhere to the opening portions of all of the channels 6.

The liquid jet head 1 illustrated in FIG. 1C differs from the above-mentioned basic configurations of FIGS. 1A and 1B in that, in the longitudinal direction of the channel 6, the supply port 2 and the discharge port 3 are positioned without facing in front of each other. In other words, in the nozzle arraying direction, the supply port 2 is positioned at one end portion of the liquid supply chamber 4, and the discharge port 3 is positioned at the other end portion of the liquid discharge chamber 5.

In this case, the supply port 2 and the discharge port 3 do not face each other. Therefore, there is an effect that, when a tube (now shown) is to be mounted to one port, a tube (not shown) mounted to the other port does not interrupt the mounting, and hence the tube can be easily mounted.

Note that, the communication path 9 illustrated in FIG. 1C is provided on each of both the one end side and the other end side in the nozzle arraying direction, but the present invention is not limited to this form. The communication path 9 may be provided on one of the one end side and the other end side in the nozzle arraying direction. When the communication path 9 is provided on one end side, it is preferred to set the port on the other end side in the nozzle arraying direction as the supply port 2. With this, when the liquid flowing in from the supply port 2 on the one end side passes through the liquid supply chamber 4, the captured air bubble and foreign matters may move through the liquid supply chamber 4 toward the other end side, and pass through the communication path 9 positioned on the other end side to be discharged from, the discharge port 3 via the liquid discharge chamber 5.

Note that, when the communication paths 9 are arranged on both sides, regardless of which port is provided on the in-flow side, the communication path 9 farther from the port on the in-flow side helps discharging of the above-mentioned air bubble and foreign matters. In other words, any one of the ports may be used as the supply port 2 (or the discharge port 3).

Further, it is preferred that the groove width and the groove depth of the communication path 9 be set larger than the groove width and the groove depth of the channel 6 so that the flow path resistance of the communication path 9 between the liquid supply chamber 4 and the liquid discharge chamber 5 is smaller than the flow path resistance of the channel 6. Note that, as described later, in the case where the channel row 7 is formed by alternately arraying the ejection channels and the dummy channels, and the liquid is caused to flow into the channels 6 via the slits, it is preferred that the groove width of the communication path 9 be larger than the groove width of the slit. In the following, the present invention is specifically described by means of embodiments.

(First Embodiment)

Figure 2A:
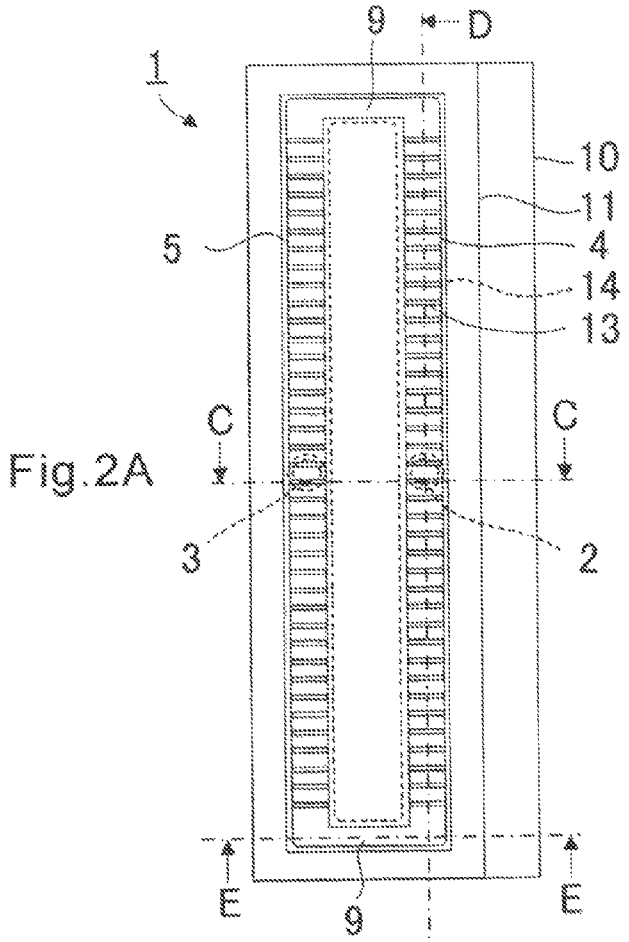
FIGS. 2A to 2E are views illustrating a liquid jet head according to a first embodiment of the present invention.
Figure 2C:
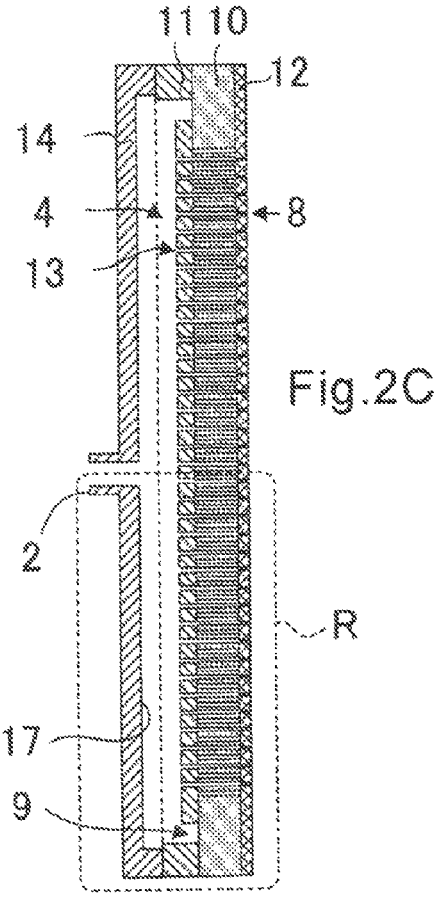
Figure 2B:
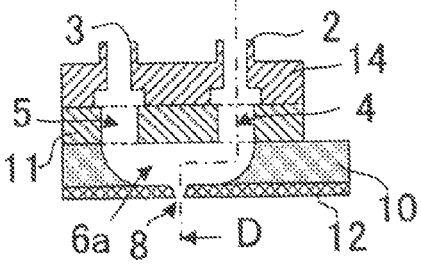
Figure 2D:
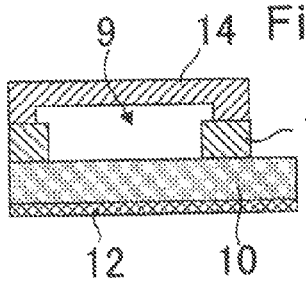
Figure 2E:
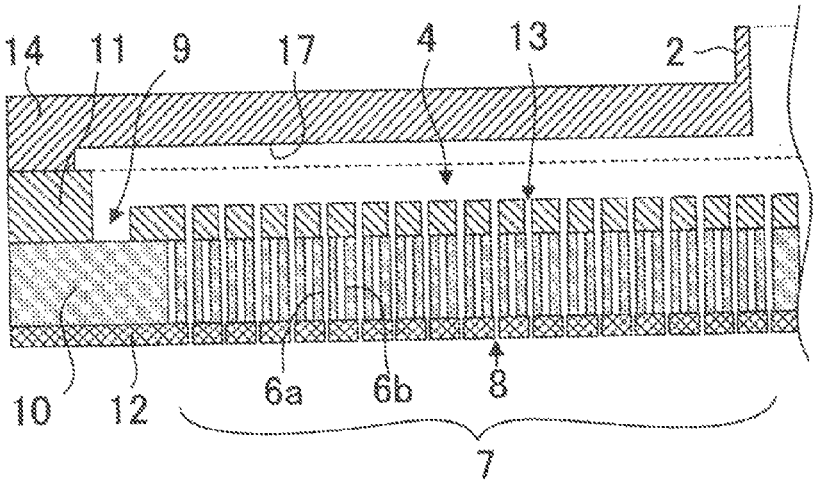

FIGS. 2A to 2E are views illustrating a liquid jet head 1 according to a first embodiment of the present invention. FIG. 2A is a schematic top view of the liquid jet head 1 from which a flow path member 14 is removed. FIG. 2B is a schematic vertical-sectional view taken along the line C-C of FIG. 2A. FIG. 2C is a schematic vertical-sectional view taken along the line D-D of FIG. 2A. FIG. 2D is a schematic vertical-sectional view taken along the line E-E of FIG. 2A. FIG. 2E is an enlarged view of the part R.

As illustrated in FIG. 2B, the liquid jet head 1 includes a laminated structure of a nozzle plate 12, an actuator substrate 10, a cover plate 11, and the flow path member 14. The upper side of the cover plate 11 is bonded to the underside of the flow path member 14 and the underside of the cover plate 11 is bonded to the upper side of the actuator substrate 10, and the underside of the actuator substrate 10 is bonded to the upper side of the nozzle plate 12. As illustrated in FIGS. 2C and 2E, the actuator substrate 10 includes the channel row 7 including ejection channels 6*a* and dummy channels 6*b* which are alternately arranged. The cover plate 11 includes the liquid supply chamber 4 and the liquid discharge chamber 5, which are each formed of an elongated recessed portion, and slits 13 are formed at a bottom portion of each recessed portion. The ejection channels 6*a* and each of the liquid supply chamber 4 and the liquid discharge chamber 5 are communicated with each other via the slits 13. The dummy channels 6*b* are closed by the cover plate 11.

The flow path member 14 includes the supply port 2 and the discharge port 3. The supply port 2 is communicated with the liquid supply chamber 4, and is positioned at substantially the center of the liquid supply chamber 4. The discharge port 3 is communicated with the liquid discharge chamber 5, and is positioned at substantially the center of the liquid discharge chamber 5. The flow path member 14 includes a recessed portion 17 on the cover plate 11 side thereof so as to correspond to each of the liquid supply chamber 4 and the liquid discharge chamber 5. The recessed portion 17 forms a part of the liquid supply chamber 4 or a part of the liquid discharge chamber 5, thereby enlarging the flow path volume of the liquid supply chamber 4 and the liquid, discharge chamber 5. The nozzle plate 12 includes the plurality of nozzles 8 communicated with the plurality of ejection channels 6*a*, respectively.

The communication path 9 is provided in the vicinity of the ejection channel 6*a* farthest from a position to which the supply port 2 of the liquid supply chamber 4 is connected, that is, in the vicinity of each of both ends of the channel row 7 in the row direction. In this embodiment, the communication path 9 is provided in both the cover plate 11 and the flow path member 14, i.e., the communication path is formed partly in the cover plate and partly in the flow path member as shown in FIG. 2D. As illustrated in FIGS. 2A and 2D, the communication paths 9 are provided across the supply chamber 4 and the liquid discharge chamber 5 at both end portions of each of the liquid supply chamber 4 and the liquid discharge chamber 5 of the cover plate 11 in the row direction of the channel row 7. The communication path 9 is formed so that its flow path resistance is smaller than those of the ejection channel 6*a* and the slit 13.

As described above, the communication path 9 for bypassing the liquid from the liquid supply chamber 4 to the liquid discharge chamber 5 is provided in the vicinity of the channel 6 farthest from the position to which the supply port 2 is connected, and hence a liquid flow is generated in a region of the liquid supply chamber 4 separated from the supply port 2. As a result, the flow of liquid that crosses the opening portions of the slits 13 becomes large, and thus the air bubble is less liable to adhere to the opening portions of the slits 13. Further, even when the air bubble adheres to the opening portions of the slits 13, the adhering air bubble can be easily removed via the liquid discharge scanner 5 and the discharge port 3 by pumping liquid from the supply port 2 to carry the air bubble toward the communication path 9.

(Second Embodiment)

Figure 3:
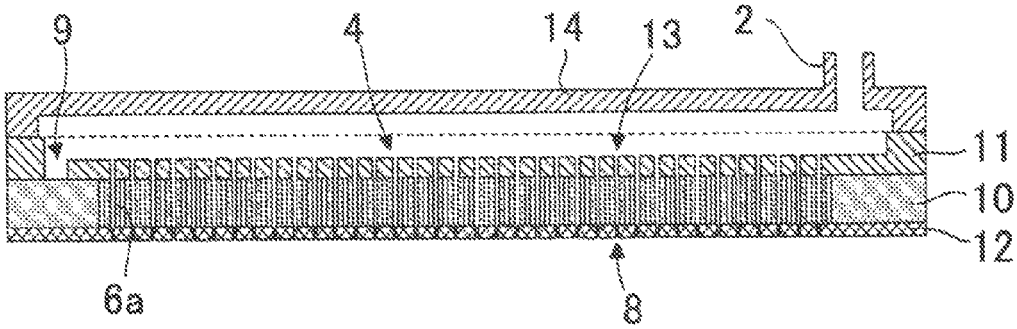
FIG. 3 is a schematic vertical-sectional view illustrating a liquid jet head according to a second embodiment of the present invention.

FIG. 3 is a schematic vertical-sectional view illustrating a liquid jet head 1 according to a second embodiment of the present invention. FIG. 3 is a sectional view corresponding to FIG. 2C. The second embodiment differs from the first embodiment in the position of the supply port 2 in the flow path member 14 and the position at which the communication path 9 is provided. Other parts are similar to those of the first embodiment. Therefore, the different parts are hereinafter described.

As illustrated in FIG. 3, the supply port 2 is provided on one end portion side of the flow path member 14. The communication path 9 is provided in the vicinity of the ejection channel 6*a* farthest from the position at which the supply port 2 is provided, and the communication path 9 bypasses the liquid from the liquid supply chamber 4 to the liquid discharge chamber (not shown). The discharge port (not shown) may be provided at one end portion of the flow path member 14 similarly to the supply port 2, or may be provided at the other end portion of the flow path member 121 differently from the supply port 2. Other configurations are the same as those in the first embodiment, and hence description thereof is omitted.

When the communication path 9 is provided as described above, a liquid flow is generated in a region of the liquid supply chamber 4 separated from the supply port 2. As a result, the flow of liquid that crosses the opening portions of the slits 13 becomes large, and thus the air bubble is less liable to adhere to the opening portions of the slits 13. Further, even when the air bubble adheres to the opening portions of the slits 13, the adhering air bubble can be easily removed via the liquid discharge chamber 5 and the discharge port 3 by pumping liquid from the supply port 2 so carry the air bubble toward the communication path 9.

(Third Embodiment)

Figure 4A:
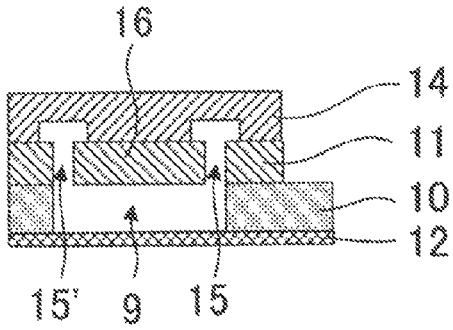
FIGS. 4A and 4B are views illustrating a liquid jet head according to a third embodiment of the present invention.
Figure 4B:
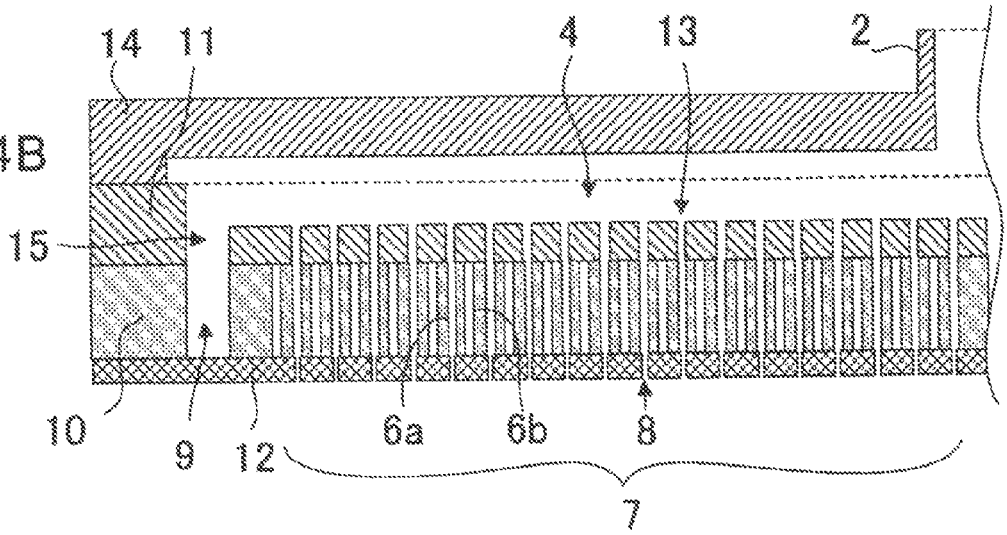

FIGS. 4A and 4B are views illustrating a liquid jet head 1 according to a third embodiment of the present invention. FIG. 4A corresponds to FIG. 2D, and illustrates a schematic vertical-section view of the communication path 9. FIG. 4B corresponds to FIG. 2E. The third embodiment differs from the first embodiment in that the communication path 9 is formed in the actuator substrate 10. Other parts are similar to those of the first embodiment. Therefore, the different part is hereinafter described.

As illustrated in FIGS. 4A and 4B, the communication path 9 is formed in the actuator substrate 10 in the vicinity of the ejection channel 6*a* farthest from the supply port 2. Further, the liquid supply chamber 4 of the cover plate 11 is extended up to the upper side of the communication path 9 of the actuator substrate 10. Then a through hole 15 is formed at the bottom portion of the liquid supply chamber 4 so that the liquid supply chamber 4 is communicated with the communication path 9. Similarly, the liquid discharge chamber (not shown) is extended up to the upper side of the communication path 9, and a through hole 15' is formed at the bottom portion of the liquid discharge chamber 5 so that the liquid discharge chamber 5 is communicated with the communication path 9. With this, an end portion of the liquid supply chamber 4 is communicated with the liquid discharge chamber 5 via the through hole 15, the communication path 9, and the through hole 15'. Note that, as in the first embodiment, a part 16 of the cover plate 11 between, the liquid supply chamber 4 and the liquid discharge chamber 5 may be removed to form the communication path 9. Through formation as described above, the communication path 9 can be easily formed to have a flow path resistance smaller than those of the channel 6 and the slit 13.

In the above-mentioned embodiments, there is described a case where one channel row 7 is formed in the actuator substrate 10, but the present invention is not limited thereto. The present invention also encompasses a case where, in the liquid jet head 1 having a plurality of channel rows 7 formed therein, the communication path 9 for bypassing the liquid from the liquid supply chamber 4 to the liquid discharge chamber 5 is formed in the vicinity of the ejection channel 6*a* farthest from the position of the supply port 2.

(Fourth Embodiment)

Figure 5A:
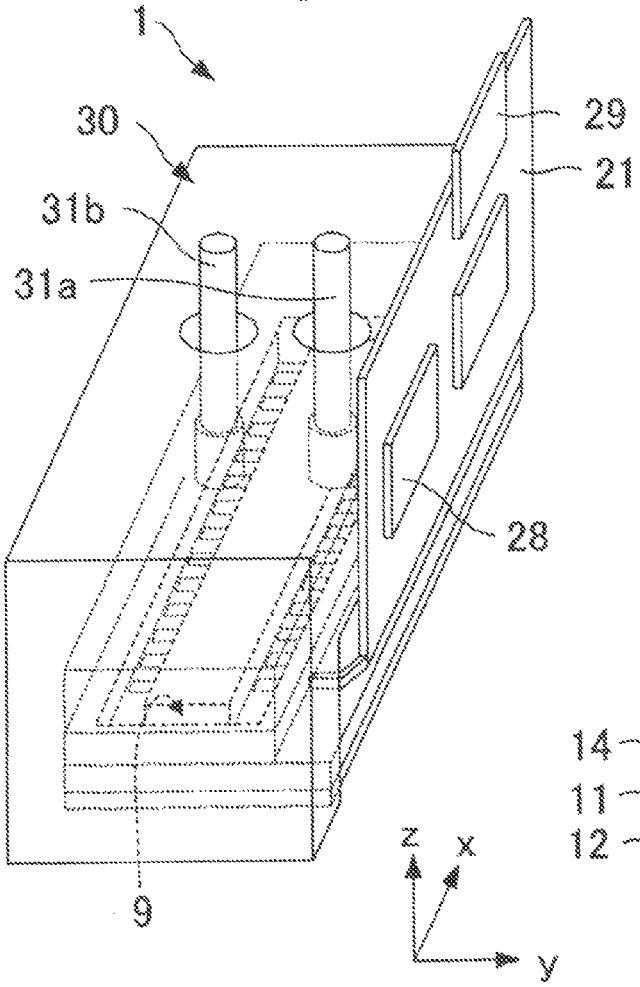
FIGS. 5A and 5B are schematic perspective views of a liquid jet head according a fourth embodiment of the present invention.
Figure 5B:
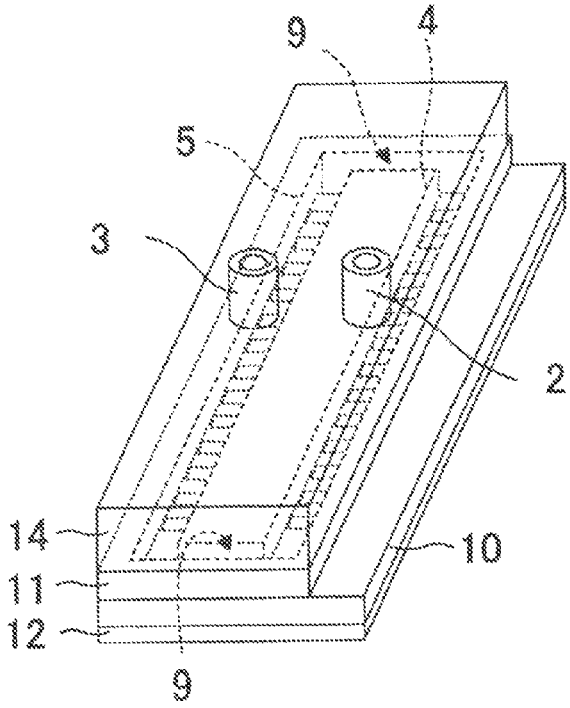

FIGS. 5A and 5B are schematic perspective views of a liquid jet head 1 according to a fourth embodiment of the present invention. FIG. 5A is a perspective view of the entire liquid jet head 1, and FIG. 5B is a perspective view of the inside of the liquid jet head 1.

As illustrated in FIGS. 5A and 5B, the liquid jet head 1 has a laminated structure of the nozzle plate 12, the actuator substrate 10, the cover plate 11, and the flow path member 14. This laminated structure is the same as those in the first to third embodiments. The nozzle plate 12 and the actuator substrate 10 each have a y-direction width which is larger than a y-direction width of each of the cover plate 11 and the flow path member 14. The cover plate 11 is bonded to the actuator substrate 10 so that one end portion of the actuator substrate 10 is exposed. Electrode terminals (not shown) are formed on an exposed upper surface of the actuator substrate 10. The cover plate 11 includes the communication path 9 that communicates the liquid supply chamber 4 and the liquid discharge chamber 5 to each other at each of both x-direction end portions.

The flow path member 14 includes recessed portions (not shown) opened in the surface on the cover plate 11 side at positions corresponding to the liquid supply chamber 4 and the liquid discharge chamber 5 of the cover plate 11, and includes the supply port 2 communicated with the liquid supply chamber 4 and the discharge port 3 communicated with the liquid discharge chamber 5, which are formed on the surface on a side opposite to the cover plate 11.

A flexible substrate 21 is bonded en the exposed upper surface of the actuator substrate 10. A large number of wiring electrodes (not shown) are formed on the flexible substrate 21, and are electrically connected to the electrode terminals (not shown) formed on the exposed upper surface of the actuator substrate 10. The flexible substrate 11 includes, on its surface, a driver IC 28 as a drive circuit and a connector 29. The driver IC 28 generates a drive signal for driving the channel 6 (not shown) baaed on a signal input from the connector 29, and supplies the generated drive signal to the drive electrode (not shown) via the electrode terminal (not shown).

A base 30 houses the laminate of the nozzle plate 12, the actuator substrate 10, the cover plate 11, and the flow path member 14. A liquid jetting surface of the nozzle plate 12 is exposed at a lower surface of the base 30. The flexible substrate 21 is pulled outside from a side surface of the base 30, and is fixed to an outer surface of the base 30. The base 30 includes two through holes in an upper surface thereof. A supply tubs 31*a* for liquid supply is connected to the supply port 2 while passing through one through hole, and a discharge tube 31*b* for liquid discharge is connected to the discharge port 3 while passing through the other through hole.

The flow path member 14 is provided so as to supply liquid from an upper side and discharge the liquid to the upper side. Further, the driver IC 28 is mounted on the flexible substrate 21, and the flexible substrate 21 is bent to be provided upright in a z direction. The flexible substrate 21 is bonded to the upper surface of the actuator substrate 10 on the side opposite to the liquid ejection surface, and hence a space around the wiring can be sufficiently secured. Further, the driver IC 28 and the actuator substrate 10 generate heat when being driven, but the heat is transferred to the liquid flowing inside via the base 30 and the flow path member 14. That is, with use of recording liquid for a recording medium as a cooling medium, the heat generated inside can be efficiently dissipated outside. Therefore, the driver IC 28 and the actuator substrate 10 can be prevented from being lowered in driving ability due to overheating. Further, because the liquid circulates inside the groove and the communication path 9 is formed, even when an air bubble is mixed, the air bubble can be rapidly discharged to the outside. Thus, the liquid is not wasted, and it is also possible to suppress wasteful consumption of the recording medium due to recording failure. In this manner, it is possible to provide the liquid jet head 1 having high reliability.

(Liquid Jet Apparatus)

(Fifth Embodiment)

Figure 6:
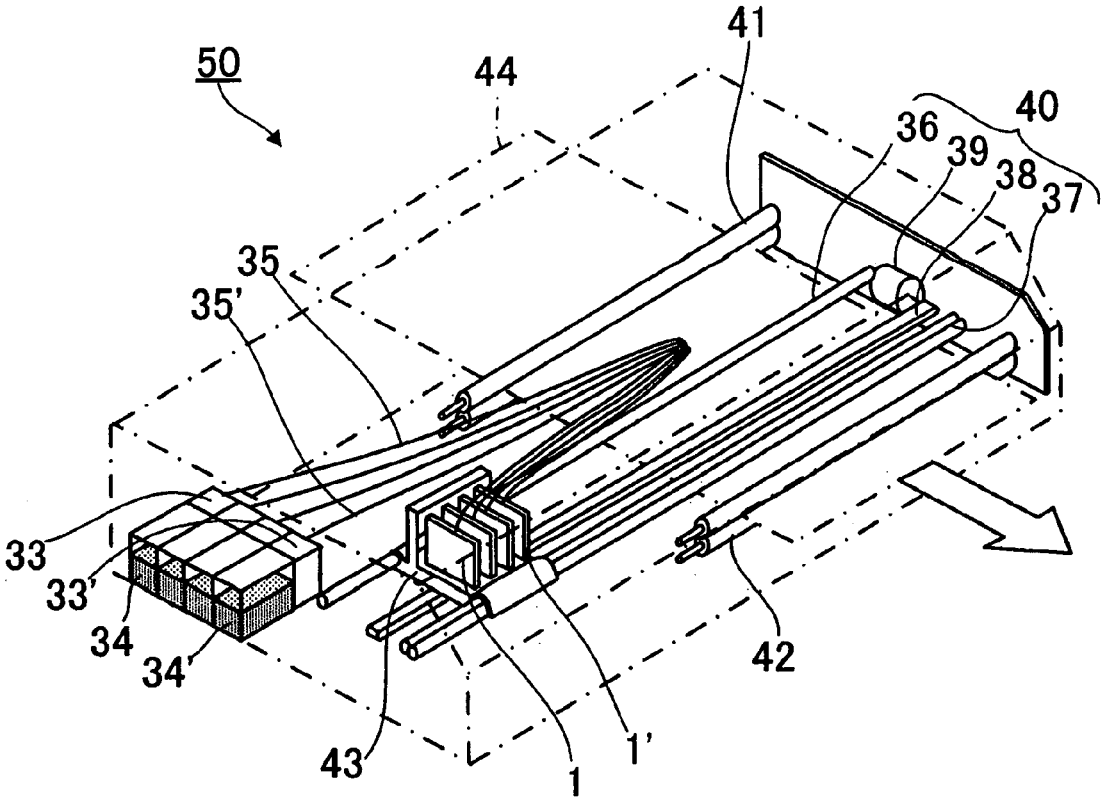
FIG. 6 is a schematic perspective view of a liquid jet apparatus according to a fifth embodiment of the present invention.
Figure 7:
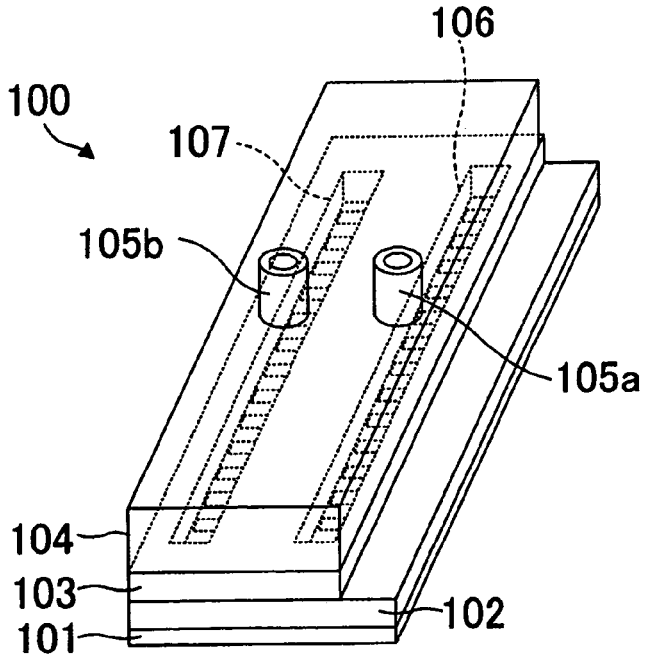
Fig.7 PRIOR ART
FIG. 7 is a perspective view of a conventionally-known liquid jet head.
Figure 8A:
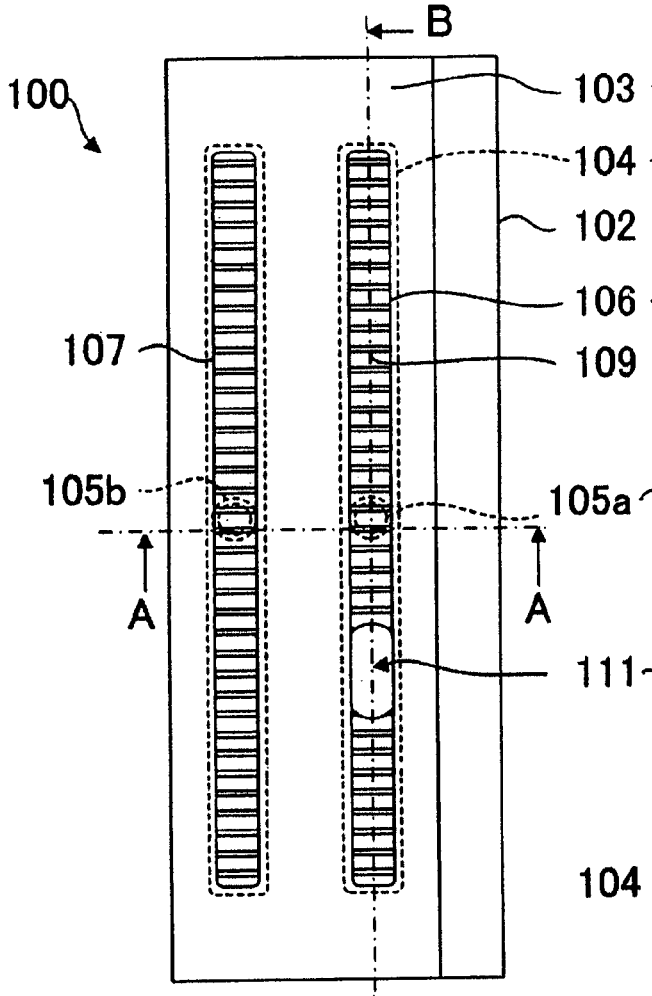
Fig.8A PRIOR ART
FIGS. 8A to 8C are schematic views of the conventionally-known liquid jet head.
Figure 8C:
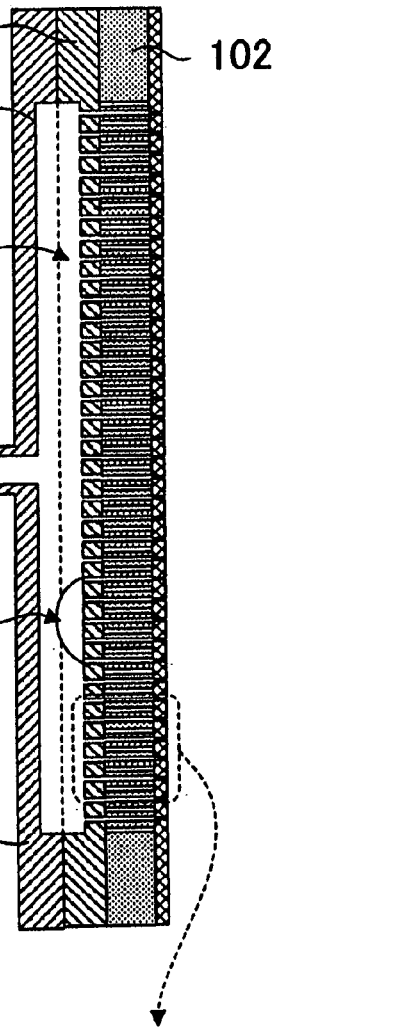
Fig.8C PRIOR ART
Figure 8B:
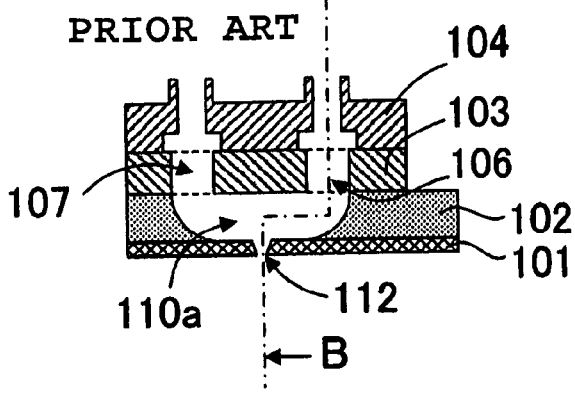
Fig.8B PRIOR ART

FIG. 6 is a schematic perspective view of a liquid jet apparatus 50 according to a fifth embodiment of the present invention. The liquid jet apparatus 50 includes a moving mechanism 40 for reciprocating liquid jet heads 1 and 1', flow path portions 35 and 35' for supplying liquid to the liquid jet heads 1 and 1' and collecting the liquid from the liquid jet heads 1 and 1', and liquid pumps 33 and 33' and liquid tanks 34 and 34' for circulating liquid to the flow path portions 35 and 33' and the liquid jet heads 1 and 1'. Each of the liquid jet heads 1 and 1' includes a plurality of ejection grooves, and a liquid droplet is ejected through a nozzle which communicates with each of the ejection grooves. As the liquid jet heads 1 and 1', any ones of the liquid jet heads of the first to fourth embodiments described above are used.

The liquid jet apparatus 50 includes a pair of conveyance means 41 and 42 for conveying a recording medium 44 such as paper in a main scanning direction, the liquid jet heads 1 and 1' for ejecting liquid toward the recording medium 44, a carriage unit 43 tor mounting thereon the liquid jet heads 1 and 1', the liquid pumps 33 and 33' for pressurizing liquid stored in the liquid tanks 34 and 34' into the flow path portions 35 and 35' for circulation, and the moving mechanism 40 for causing the liquid jet heads 1 and 1' to scan in a sub-scanning direction which is orthogonal to the main scanning direction. A control portion (not shown) controls and drives the liquid jet heads 1 and 1', the moving mechanism 40, and the conveyance means 41 and 42.

Each of the pair of conveyance means 41 and 42 includes a grid roller and a pinch roller which extend in the sub-scanning direction and which rotate with roller surfaces thereof being in contact with each other. A motor (not shown) axially rotates the grid rollers and the pinch rollers to convey in the main scanning direction the recording medium 44 sandwiched therebetween. The moving mechanism 40 includes a pair of guide rails 36 and 37 which extend in the sub-scanning direction, the carriage unit 43 which is slidable along the pair of guide rails 36 and 37, an endless belt 38 which is coupled to the carriage unit 43 for moving the carriage unit 43 in the sub-scanning direction, and a motor 39 for rotating the endless belt 39 via a pulley (not shown).

The carriage unit 43 has the plurality of liquid jet heads 1 and 1' mounted thereon for ejecting, for example, four kinds of liquid droplets: yellow; magenta; cyan; and black. The liquid tanks 34 and 34' store liquid of corresponding colors, and circulate the liquid via the liquid pumps 33 and 33' and the flow path portions 35 and 35' to the liquid jet heads 1 and 1'. The respective liquid get heads 1 and 1' eject liquid droplets of the respective colors in accordance with a drive signal. Through control of ejection timings of liquid from the liquid jet heads 1 and 1', rotation of the motor 39 for driving the carriage unit 43, and conveyance speed of the recording medium 44, an arbitrary pattern may be recorded on the recording medium 44.

(Sixth Embodiment)

Figure 9A:
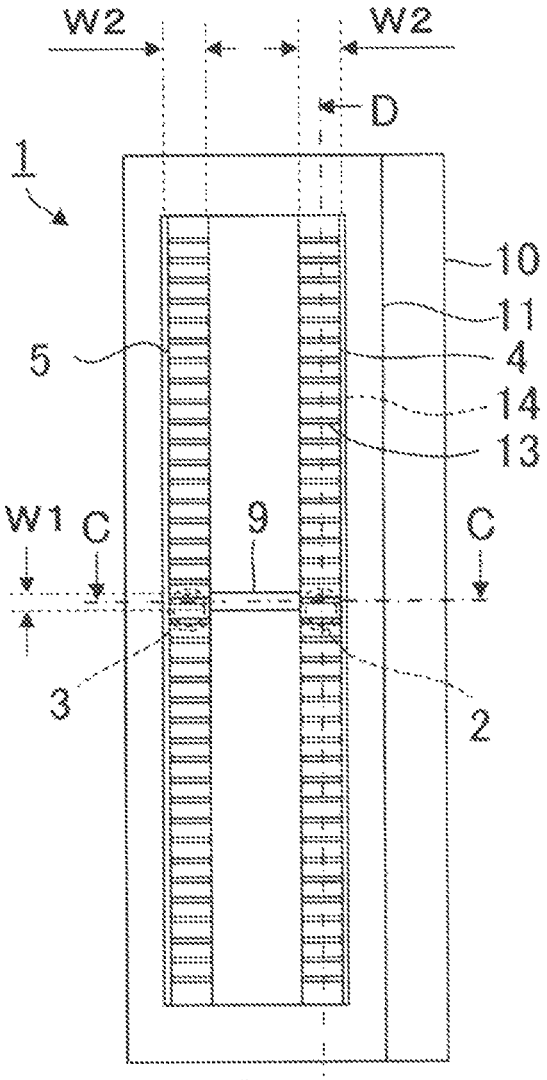
FIGS. 9A to 9C are views illustrating a liquid jet head according to a sixth embodiment of the present invention.
Figure 9C:
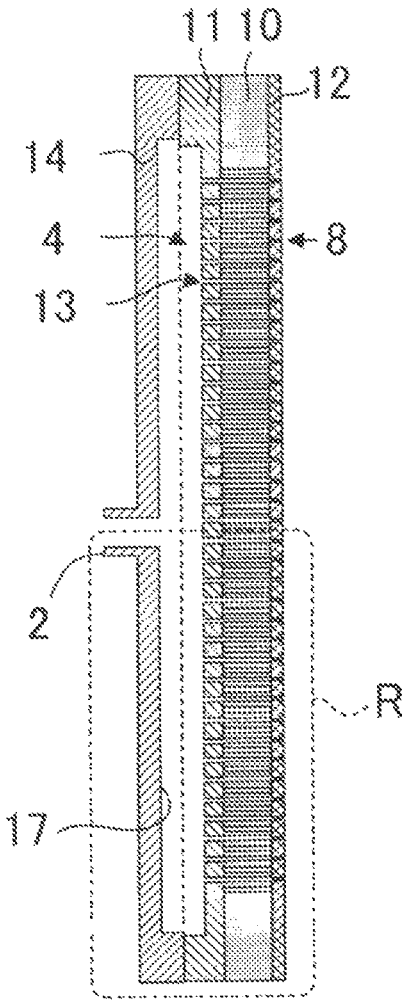
Figure 9B:
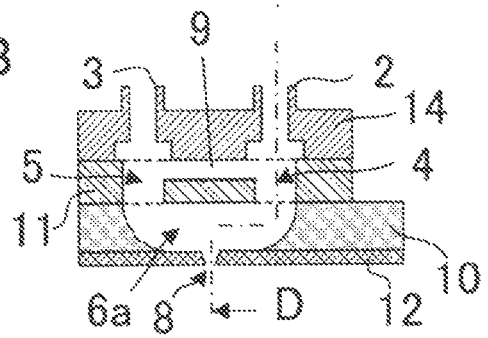

FIGS. 9A to 9C are views illustrating a liquid jet head 1 according to a sixth embodiment of the present invention. The sixth embodiment illustrated in FIGS. 9A to 9C differs from the above-mentioned embodiments in that the communication path 9 is formed in only the cover plate 11 and the communication path 9 is formed not at the end portion in the nozzle arraying direction but at the center in the nozzle arraying direction.

First, as illustrated in FIG. 9B, the communication path 9 is formed by removing a part of the cover plate 11 between the liquid supply chamber 4 and the liquid discharge chamber 5 of the cover plate 11. The depth of the removed part in the thickness direction can be formed equivalent to a depth of substantially the half of the thickness of the cover plate 11 or a depth that becomes a boundary between the liquid supply chamber 4 and the slit 13. In other words, the communication path 9 is a flow path formed of a recessed portion of the cover plate 11, which is formed on the flow path member side at a predetermined depth, and a bonding surface of the flow path member 14 bonded to the cover plate 11 so as to cover an upper surface of the recessed portion.

Next, as illustrated in FIG. 9A, the communication path 9 is formed at substantially the center position in the nozzle arraying direction. Further, the communication path 9 is formed so that its width W1 is smaller than a width W2 of each of the liquid supply chamber 4 and the liquid discharge chamber 5 and a total width of all of the slits 13. Still further, the communication path 9 is formed so that its sectional area in the channel formation direction is smaller than a sectional area in the nozzle arraying direction of each of the liquid supply chamber 4 and the liquid discharge chamber 5 and a total sectional area of all of the slits 13. With this, in the flow path configuration of the communication path 9, the liquid supply chamber 4, the liquid discharge chamber 5, and the slits 13, the air bubble passes through the communication path 9, and the liquid passes through not the communication path 9 but the liquid supply chamber 4, the liquid discharge chamber 5, and the slits 13.

(Seventh Embodiment)

FIGS. 10A to 10E are views illustrating a liquid jet head 1 according to a seventh embodiment of the present invention. The seventh embodiment illustrated in FIGS. 10A to 10E differs from the above-mentioned sixth embodiment in that the communication path 9 is formed not at the center in the nozzle arraying direction but at each of both end portions in the nozzle arraying direction. The point that the communication path 9 is formed only in the cover plate 11 is the same in the sixth and seventh embodiments.

Figures 10A, 10B, 10C, 10D, 10E:
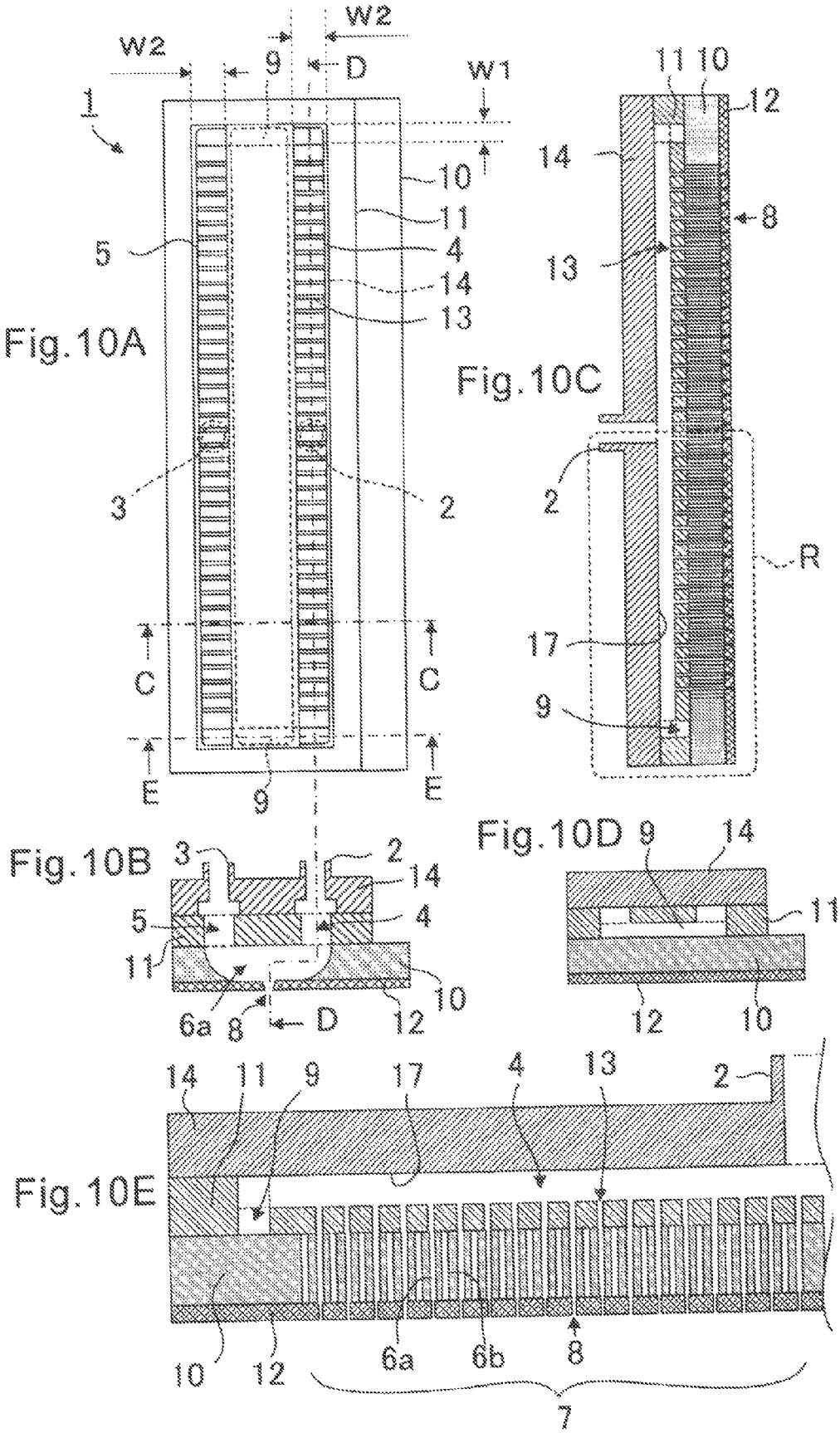
FIGS. 10A to 10E are views illustrating a liquid jet head according to a seventh embodiment of the present invention.

First, as illustrated in FIG. 10A, the communication path 9 is formed at each of positions at both the end portions in the nozzle arraying direction. Further, the communication path 9 is formed so that its width W1 is smaller than the width W2 of each of the liquid supply chamber 4 and the liquid discharge chamber 5 and the total width of all of the slits 13. Still further, the communication path 9 is formed so that its sectional area in the channel formation direction is smaller than the sectional area in the nozzle arraying direction of each of the liquid supply chamber 4 and the liquid discharge chamber 5 and the total sectional area of all of the slits 13. With this, in the flow path configuration of the communication path 9, the liquid supply chamber 4, the liquid discharge chamber 5, and the slits 13, the air bubble passes through the communication path 9, and the liquid passes through not the communication path 9 but the liquid supply chamber 4, the liquid discharge chamber 5, and the slits 13.

Next, as illustrated in FIG. 10D, the communication path 9 is formed by removing a pact of the cover plate 11 between the liquid supply chamber 4 and the liquid discharge chamber 5 of the cover plate 11. The depth of the removed part in the thickness direction can be formed equivalent to the depth of substantially the half of the thickness of the cover plate 11 or the depth of the slit 13. In other words, the communication path 9 is a flow path formed of a recessed portion of the cover plate 11, which is formed on the actuator substrate 10 side at a predetermined depth, and a bonding surface of the actuator substrate 10 bonded to the cover plate 11 so as to cover a lower surface of the recessed portion.

What is claimed is:

1. A liquid jet head, comprising:

a flow path member having a supply port through which liquid is supplied and a discharge port through which the liquid is discharged;

a cover plate connected to an underside of the flow path member and having a liquid supply chamber that communicates with the supply port and a liquid discharge chamber that communicates with the discharge port;

a channel row arranged beneath the cover plate and formed of a plurality of channels provided in parallel to each other between the liquid supply chamber and the liquid discharge chamber, the plurality of channels each having one end portion communicating with the liquid supply chamber and another end portion communicating with the liquid discharge chamber so that the liquid flows through the channels from one end portion to the other end portion;

a plurality of nozzles that communicates with the plurality of channels, respectively; and a communication path provided in one or both of the cover plate and the flow path member for bypassing the liquid from the liquid supply chamber to the liquid discharge chamber so that air bubbles accumulated in the liquid supply chamber are discharged through the communication path to the liquid discharge chamber.

2. A liquid jet head according to claim 1, wherein the communication path is provided in a vicinity of a channel farthest from a position of the supply port.

3. A liquid jet head according to claim 1, wherein the supply port is positioned at substantially a longitudinal center of one of the liquid supply chamber and the liquid discharge chamber, and wherein the communication path is provided in a vicinity of each of both ends of the channel row in a row direction.

4. A liquid jet head according to claim 1, wherein the supply port is positioned at one longitudinal end portion of the liquid supply chamber, and wherein the communication path is provided in a vicinity of an end portion of the channel row, which corresponds to another longitudinal end portion.

5. A liquid jet head according to claim 1, wherein the supply port is positioned at one longitudinal end portion of the liquid supply chamber, wherein the discharge port is positioned at another longitudinal end portion of the liquid discharge chamber, and wherein the communication path is provided in a vicinity of each of both ends of the channel row in a row direction.

6. A liquid jet head according to claim 1, wherein the supply port is positioned at one longitudinal end portion of the liquid supply chamber, wherein the discharge port is positioned at another longitudinal end portion of the liquid discharge chamber, and wherein the communication path is provided in a vicinity of an end portion of the channel row, which corresponds to the another longitudinal end portion.

7. A liquid jet head according to claim 1, wherein the communication path has a flow path resistance which is smaller than a flow path resistance of the plurality of channels.

8. A liquid jet head according to claim 1, further comprising:

an actuator substrate having the channel row formed therein; and a nozzle plate bonded to an underside of the actuator substrate and having the plurality of nozzles formed therein, wherein the cover plate is bonded to an upper side of the actuator substrate, and the flow path member is bonded to an upper side of the cover plate.

9. A liquid jet head according to claim 8, wherein the channel row comprises dummy channels and ejection channels which are alternately arrayed, wherein the cover plate has slits between the channel row and each of the liquid supply chamber and the liquid discharge chamber, and wherein the liquid supply chamber and the liquid discharge chamber communicate with the ejection channels via the slits, and each of the plurality of nozzles communicates with a respective one of the ejection channels.

10. A liquid jet head according to claim 8, wherein the communication path is provided in the cover plate.

11. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

12. A liquid jet head according to claim 1, wherein the underside of the flow path member has two recessed portions, one communicating with the supply port and opening directly into the liquid supply chamber and the other communicating with the discharge port and opening directly into the liquid discharge chamber.

13. A liquid jet head according to claim 12, wherein the two recessed portions overlie opposite side portions, respectively, of the entire channel row.

14. liquid jet head according to claim 1, wherein the flow path member and the cover plate comprise a laminated structure.

15. A liquid jet head according to claim 1, wherein the nozzles are located at the longitudinal centers of the respective channels.

16. A liquid jet head, comprising:

a flow path member having a supply port through which liquid is supplied and a discharge port through which the liquid is discharged;

a cover plate connected to an underside of the flow path member and having a liquid supply chamber that communicates directly with the supply port and a liquid discharge chamber that communicates directly with the discharge port;

a channel row arranged beneath the cover plate and formed of plural elongate channels provided in parallel to each other between the liquid supply chamber and the liquid discharge chamber, the plural channels each communicating with the liquid supply chamber and the liquid discharge chamber such that the liquid flows from the liquid supply chamber longitudinally through the channels to the liquid discharge chamber;

plural nozzles that communicate with respective ones of the plural channels; and a communication path provided in one or both of the cover plate and the flow path member for bypassing the liquid from the liquid supply chamber to the liquid discharge chamber so that air bubbles accumulated in the liquid supply chamber are discharged through the communication path to the liquid discharge chamber.

17. A liquid jet head according to claim 16, wherein the elongate channels each have opposite end portions one of which communicates with the liquid supply chamber and the other of which communicates with the liquid discharge chamber.

18. A liquid jet head according to claim 17, wherein the underside of the flow path member has two recessed portions, one communicating with the supply port and opening directly into the liquid supply chamber and the other communicating with the discharge port and opening directly into the liquid discharge chamber.

19. A liquid jet head according to claim 18, wherein the two recessed portions overlie opposite side portions, respectively, of the entire channel row.

20. A liquid jet head according to claim 16, wherein the nozzles are located at the longitudinal centers of the respective channels.

* * * * *